United States Patent [19]

Stoll

[11] Patent Number: 4,787,515

[45] Date of Patent: Nov. 29, 1988

[54] TOTE CONTAINER WITH REMOVABLE HINGED LID AND COMBINED HANDGRIP/STACKING FRAME

[75] Inventor: Mark S. Stoll, Deephaven, Minn.

[73] Assignee: Liberty Diversified Industries, New Hope, Minn.

[21] Appl. No.: 911,993

[22] Filed: Sep. 26, 1986

[51] Int. Cl.[4] ..... B65D 5/46; B65D 21/02; B65D 61/00; B65D 5/64

[52] U.S. Cl. ..... 206/509; 206/821; 229/23 R; 229/125.08; 229/125.31

[58] Field of Search ..... 206/509, 821; 229/23 R, 229/44 R, 45, 52 B, 198, 199, 915, 916, 917, 918, 125.08, 125.11, 125.13, 125.31

[56] References Cited

U.S. PATENT DOCUMENTS

| | | | |
|---|---|---|---|
| 2,191,291 | 2/1940 | Smith | 229/199 |
| 2,201,462 | 5/1940 | Wells | 229/918 |
| 2,276,820 | 3/1942 | Bonfield | 229/45 |
| 2,465,324 | 3/1949 | De Mian | 229/44 R |
| 2,544,283 | 3/1951 | Snyder | 229/45 |
| 2,791,336 | 5/1957 | Geisler | 229/918 |
| 3,206,095 | 9/1965 | Stegner | 229/44 R |
| 3,659,774 | 5/1972 | Mielke | 229/52 B |
| 3,935,991 | 2/1976 | Crane | 229/919 |
| 4,068,794 | 1/1978 | Lawrence | 229/23 R |

FOREIGN PATENT DOCUMENTS

| | | | |
|---|---|---|---|
| 732410 | 6/1955 | United Kingdom | 229/52 B |

*Primary Examiner*—George E. Lowrance
*Attorney, Agent, or Firm*—Moore & Hansen

[57] ABSTRACT

A tote and storage container of the variety used for filing and archive purposes comprising a rectangular body folded from corrugated plastic, a combined handgrip and stacking frame member, and a lid unit which may be selectively removed from or hingedly mounted to the container. The combined handgrip and stacking frame reinforces the handgrip openings in the container body and the top corners of the container walls, provides a stacking shoulder allowing containers without lids to be stacked, and has a retaining rim to keep a vertical column of like containers stacked without the containers sliding off the top or becoming misaligned. The lid unit may be securely attached to the container to support heavy loads when the container is inverted, may be pivoted open or closed along a hinge line, or may be completely removed.

23 Claims, 3 Drawing Sheets

TOTE CONTAINER WITH REMOVABLE HINGED LID AND COMBINED HANDGRIP/STACKING FRAME

This invention relates to storage and tote containers in general, and particularly to filing or archive boxes having lids.

Cardboard and fiberboard filing or archive boxes are well known to the art and may be found in most business office settings. The filing or archive boxes are often used to store records and papers which are no longer current and would take up too much space in the standard filing cabinets. In instances where the active files are normally quite voluminous or subject to rapid turnover, the filing or archive boxes may take the place of conventional filing cabinets which would prove too expensive or cumbersome to be practical. The boxes are stacked on top of each other for storage, or are placed in lightweight metal shelving units for use as files.

The filing or archive boxes are generally rectangular containers having a body folded from a sheet of cardboard or fiberboard to form a bottom and four upright walls. The walls may be of one or two-ply construction, with the two walls at the lengthwise ends of the body having cutouts to be used as handgrips, either for carrying the boxes or sliding them in and out of the shelving units.

The container bodies are usually designed to hold standard or legal sized papers and manilla filing dividers, and may be found in a variety of suitable dimensions for specialized use such an index cards, checks, invoices, or computer printouts. The boxes may also be printed with customized labels to record the contents of each box for later reference.

While such boxes may simply have two or four top cover flaps, the more popular filing and archive boxes are equipped either with a removable or a hinged lid made from the same material as the container body. The removable lids are folded from a sheet of material to form a rectangular tray large enough to cover the top opening of the container body, with four connected side flaps which slide down over the top of the container body and lie parallel to the planar surfaces of the upright walls. In the designs having hinged lids, the original sheet of material is cut to form a blank which includes both the container body and lid, with the lid being connected to one wall of the container body across a folding hinge line scored onto the blank. Various methods have been used to secure these lids, including packaging tape, elastic or cord ties, and insertable closure tabs.

The principle drawbacks to the existing filing or archive boxes include the limitation that these boxes have either a hinged or a removable lid. Since they are often purchased in quantities, and it is desirable to have a uniform design and appearance to maintain an orderly and presentable looking office, the purchaser will order one type of box or the other. However, in some applications it is preferable to have a hinged lid, while in others a removable lid would be more appropriate. A purchaser must then order both types of boxes as needs arise, or keep an inventory of each on hadn. If a supply of one type of box is available and a person is faced with an infrequent situation requiring the use of the other type of box, they may attempt to make due with the wrong type of box and risk loss or damage to its contents, or may expend considerable time and effort modifying the available box to meet their needs.

A second drawback to existing boxes is that, while the boxes are intended to hold large quantities of heavy paper or other goods, the means used to secure the lids to the container body are often inadequate for handling. In storing the boxes, it may be necessary to tip a box on its side or end to fit it into a tight space or slide it onto a high shelf. A person might also accidentally tip the box if the contents shift suddenly, or when they are removing a heavy box from a high shelf. Likewise, in transporting the boxes, they may be subjected to rough handling, jostling, being set on end or inverted, and other conditions which would normally cause the contents to spill out. To prevent these problems, the lids must be adequately secured to the container body. If packaging tape is used, the boxes are very difficult to reopen, and the tape cannot be reused. If string, cord, or elastic are used, an ample supply must be kept on hand wherever the boxes will be packed, and each is subject to the same problems of reopening and reusing as found with tape. Both string and tape require a cutting implement to be kept available, and there is an inherent risk of injury to using the knives and rasor blade holders. Conventional insertable reclosure tabs obviate some of the inconvenience of tape and cord, but are generally not strong enough to support the full weight which the boxes are capable of holding without tearing apart.

Another limitation to the existing boxes is the inability to disassemble, unfold, and lay them flat for storage or delivery to the purchaser. Most filing or archive boxes use glue or staples in the manufacturing process to secure the side or bottom seams and ensure the boxes will be strong enough to support heavy loads which would pull unfastened folded flaps apart. Other designs increase the strength of the container by gluing multiple plys of material together to form the walls of the container body. In either case, the boxes cannot be unfolded and later reused without first destroying the original fastening and then refastening the seams, a process which greatly weakens the structural integrity of the container.

A further drawback to the existing box designs is that, while the smooth surface of the cardboard or fiberboard makes the boxes easy to slide in and out of shelving units, the combination of that smooth surface and the flat lid tops makes free-standing stacks of boxes very precarious. Such a stack can easily topple, or the top boxes slide off, if great care is not taken to stack the boxes in a straight vertical column, or if the stack is bumped or jarred by a person, machine, or vehicle. Stacking the boxes properly requires that each box being added to the stack be lined up with the boxes below it. As the stack grows higher, however, it is more likely that the act of adding a box to the stack will dislodge or misalign one or more of the lower boxes, which must then be repositioned along with the heavier load of boxes resting on top.

Still another limitation to the existing box designs is the inability to stack those boxes when the lids are removed or unhinged without having the box on top fall into the lower box or crush a section of the lower box's side walls. While it is possible to set one such box on top of another at an angle, one cannot reliably or efficiently stack several boxes in this manner.

Yet another drawback to existing boxes is found in the design of their handgrip cutouts. Most boxes merely have an oblong section of the endwalls cut out of the blank to permit a person to reach their fingers through and grip the box. While this may be adequate in industrial situations where workers can wear gloves, in an office setting these boxes must frequently be handled by secretaries and office workers who do not regularly carry gloves with them. Attempting to lift a box filled with 30 or more pounds of material on one's fingertips using only a one or two-ply thickness of cardboard can be painful and dangerous, particularly if it must be done repeatedly. More advanced designs may have sections of the endwall folded through the top of the handgrip cutout to provide a larger handle, although this consumes a disproportionate amount of material when laying out the blank and results in waste. In addition, if the portion above the handgrip is twisted or torqued inwardly or outwardly, that section of the end wall may tear away from the box, resulting in damage to the contents or injury to a person.

A further problem experienced in the existing designs for filing and archive boxes is that the upper corners of the boxes are weak points and subject to tearing, because the corners are normally folded over scored or perforated lines, and there are usually no lateral or horizontal supports extending around those corners to prevent them from tearing along those scored or perforated lines. When heavy contents within such a box shift, particularly if the box does not have a lid, pressure along the side walls may cause the corners of the box to tear apart creating an obviously undesirable result.

One previous storage box design incorporated a pair of molded plastic frames which were placed along the top of each end wall of the container and had channels into which the top edges of the end and side walls of the contianer were inserted. The frames also had molded handgrips which were inserted through handgrip cutouts in the container to reinforce the cutouts, a rim along the top surface of the frame for stacking the containers, and projections on the end of each frame which were inserted into holes in the container's side walls to lock the frames in place.

This design had several limitations, however. The frame members prevented the use of a hinged lid because the top edges of the container were obstructed by the frames. The size of the frames required that any removable lid be made much larger than customary, and because the side flaps of the lid were folded from the lid blank, the amount of material consumed by such a lid was excessive. Furthermore, the molded frames contained many ribs and protrusions within the channel necessary to secure and hold the container walls firmly inside that channel. Because of the manner in which the frame was molded, having straight sections with dimensions comparable to those of the container body, the frames were very difficult to attach and removed from the container's walls.

BRIEF SUMMARY OF THE INVENTION

Accordingly, one object of this invention is to design a filing or archive type storage and tote container in which the lid may selectively be hinged to or removed from the container body.

A second object of this invention is to design the above container such that the lid may be secured to the body in a manner allowing the lid to fully support the contents of the container in situations where the container is tilted or completely inverted.

Another object of this invention is to design the above container so that it may be repeatedly disassembled and laid flat for storage or shipping, and quickly reassembled, without weakening the structural integrity of the container or lid, and without the need for tools or fasteners.

A further object of this invention is to design the above container so that several like containers may easily be placed in a freestanding column, with each container retained from sliding out of veritcal alignment with the column by the container below it.

Still another object of this invention is to design the above container so that several like containers may be stacked in a freestanding column with the lids of each container removed or unhinged.

Yet another object of this invention is to design the above container with a handgrip which may be quickly attached or detached from the container body, and which is both comfortable and safe for carrying heavy loads, will increase the strength of the container's end walls to resist twisting or tearing, and will simultaneously aid in fastening or retaining the walls of the container in their upright positions.

One further object of this invention is to design the above container with a means for reinforcing the upper corners of the container body to prevent tearing along the corner fold lines when the container is filled with a heavy load that shifts.

Described briefly, the container of this invention has a rectangular body folded from corrugated plastic, a combined handgrip and stacking frame member, and a lid unit which may be selectively removed from or hingedly mounted to the container body.

The combined handgrip and stacking frame member, or frame grip member, as it is hereinafter referred to, has a retaining rim projecting upward to keep containers stacked in a vertical column from sliding off the top of the container below. The frame grip member also provides the stacking shoulder allowing containers without lids to be stacked, and reinforces the handgrip opening and top corners of the walls of the container body.

The lid unit may be securely attached to the container using lid secured tabs which are inserted between the end walls of the container body below the frame grip member and will support heavy loads when the container is inverted. The lid unit may be pivoted open or closed along a scored hinge line, or may repeatedly be completely removed from the container and reattached.

The container may also be disassembled and folded flat for storage or shipping.

These and other objects and advantages of the invention will become readily apparent as the following description is read in conjunction with the accompanying drawings wherein like reference numerals have been used to designate like elements throughout the several views.

DESCRIPTION OF THE PREFERRED EMBODIMENT

Figure 2:
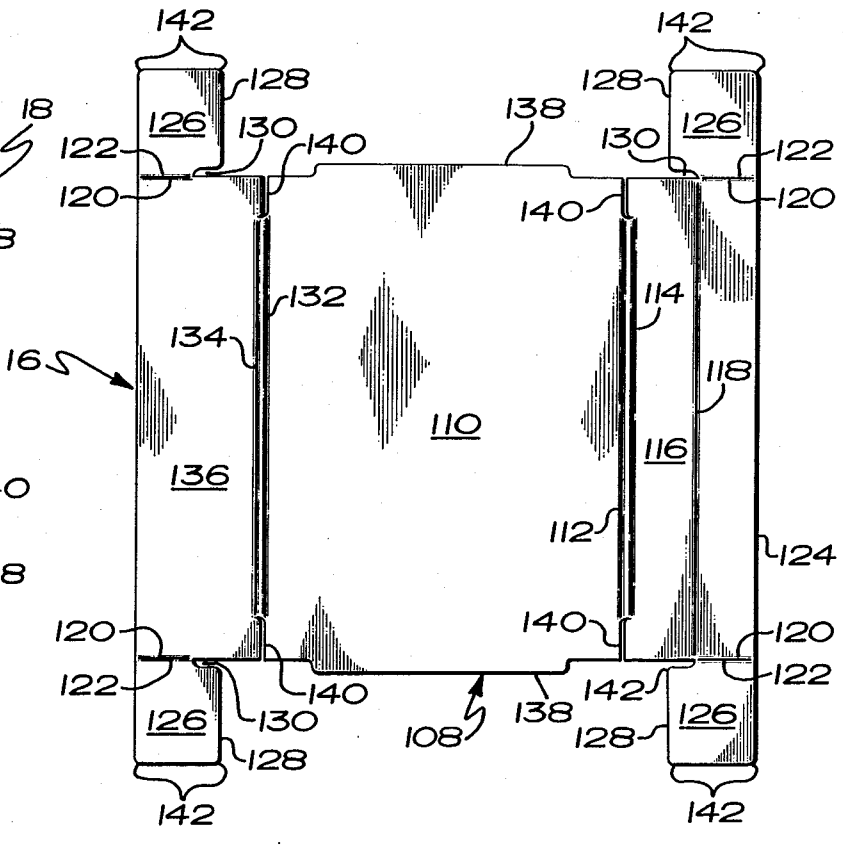
FIG. 2 is a plan view of the blank forming the lid of the tote container.

The container of this invention is shown in FIGS. 1–8 and referenced generally by the numeral 10.

The container 10 has a body referenced generally by the numeral 12, a combined frame grip unit referenced generally by the numeral 14, and a lid unit referenced generally by the numeral 16.

Figure 1:
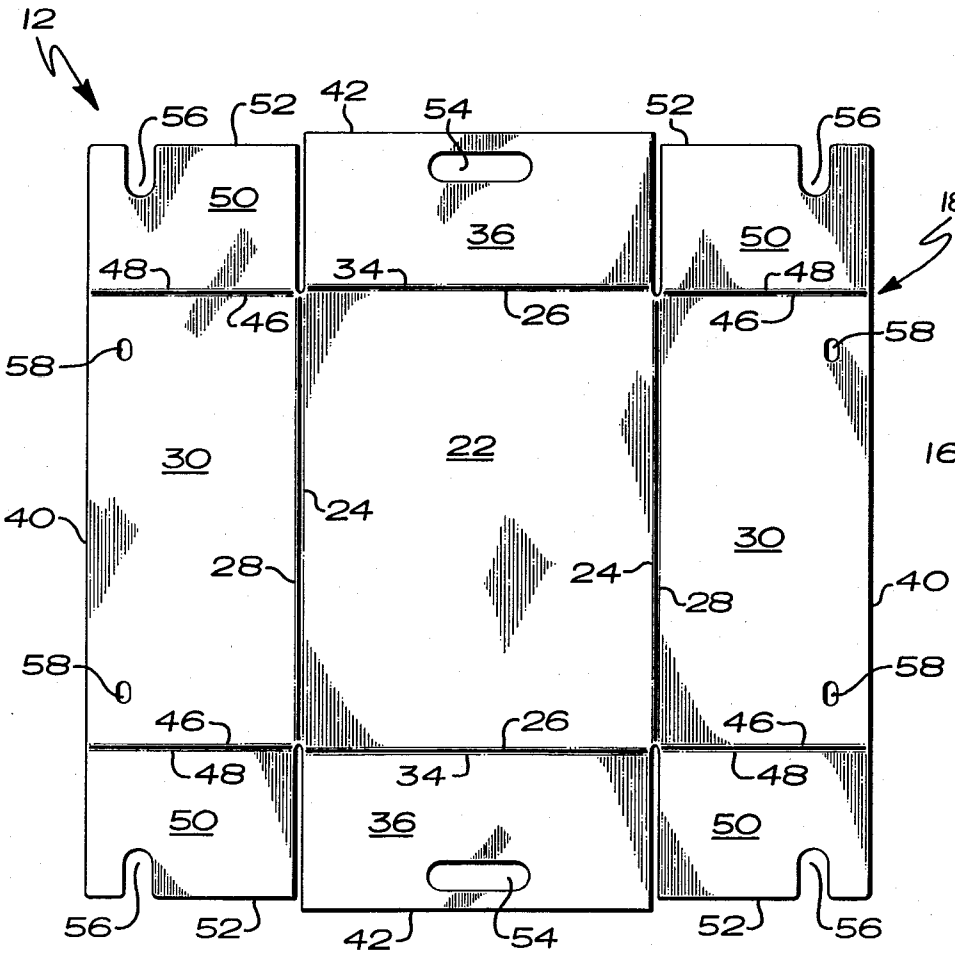
FIG. 1 is a plan view of the blank which is folded to form the body of the tote container.

The body 12 is constructed from a single sheet of corrugated plastic which is cut and scored to form a body blank 18, shown in FIG. 1, which is folded to define a generally rectangular open-top receptacle 20.

Figure 5:
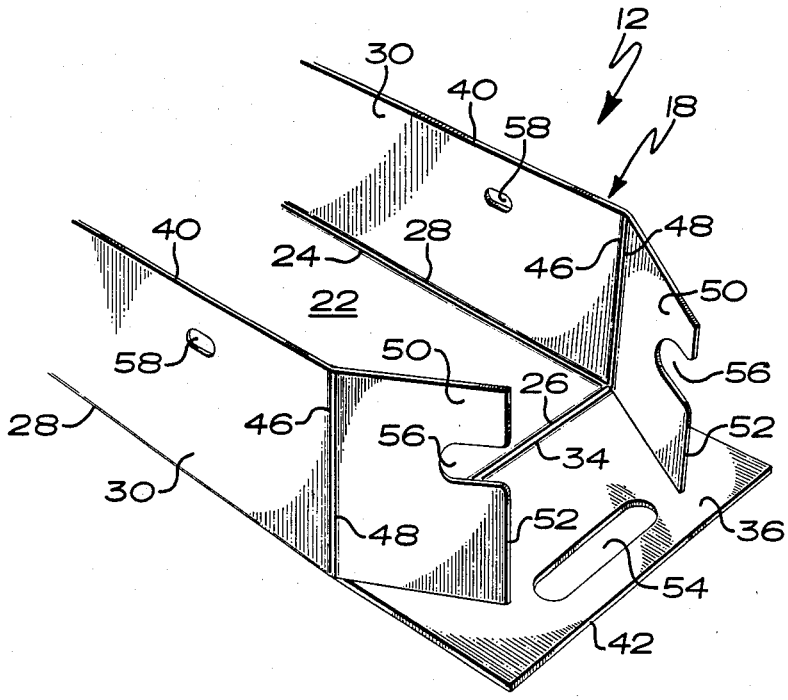
FIG. 5 is a perspective view showing the body of the tote container with the side walls folded to their upright position and the end foldover panels being folded inward.

Referring to FIG. 1, the body 12 consists of a generally planar base panel 22 having pairs of opposing side edges 24 and end edges 26. Extending outwardly from each side edge 24 of the base panel 22 and hingedly connected thereto along score lines 28 are a pair of side wall panels 30. The side wall panels 30 are folded upward at approximately ninety degree angles over the score line 28 to define the sides of the body 32 as shown in FIG. 5. Extending outwardly from each end edge 26 of the base panel 22 and hingedly connected thereto along score lines 34 are a pair of end wall panels 36. The end wall panels 36 are folded upward at approximately ninenty degree angles over the score lines 34 to define the ends of the body 38. The distance between the side edge 24 of the base panel 22 and the outer edge 40 of the side wall panel 30 is approximately equal to the distance between the end edge 26 of the base panel 22 and the outer edge 42 of the end wall panel 36. so that when the side wall panels 30 and end wall panels 36 are folded to their upright position, the outer edges 40, 42 communicate to define the open top 44 of the receptacle 20.

Extending outwardly from each end edge 46 of the side wall panels 30 and hingedly connected thereto along score lines 48 is an end fold-over panel 50. The end fold-over panels 50 are folded inwardly at approximately ninety degree angles over the score lines 48 parallel to and in abutting contact with the surface of the end wall panels 36 as shown in FIG. 5. The distance between the end edge 46 of the side wall panels 30 and the inner edges of the end fold-over panels 52 is one half the width of the end wall panels 36, so the inner edges of the end fold-over panels 52 on each end of the receptacle 38 are parallel with an in close proximity to one another.

Each end wall panel 36 defines an oblate handgrip opening 54 positioned near the top of the receptacle 44 and generally parallel to the outer edge of the end wall panel 42. Each end fold-over panel 50 has an oblate handgrip cutout 56 along the inner edge of the end fold-over panel 52 generally perpendicular to the end edge of the side wall panels 46 positioned a distance from the outer edge of the side wall panel 40 equal to the distance between the handgrip opening 54 and the outer edge of the end wall panel 42, and equal in size to one half the handgrip opening 54, so that when the end fold-over panels 50 are folded to their upright position, the handgrip cutouts 56 communicate with the overlap the handgrip openings.

The end fold-over panels 50 should be folded inward before the end wall panels 36 are folded upward, and to accommodate this configuration the base panel 22 should be made slightly longer than the side wall panels 30 between their respective end edges 26, 46 as shown in FIG. 1.

Each side wall panel 30 has a pair of small, oblate keyholes 58 positioned parallel with an in close proximity to the outer edges of the side wall panels 40 near each end edge 46, so that opposing keyholes 58 on corresponding ends of each side wall panel 30 are the same distance from the top 44 and the ends 38 of the receptacle 20.

Figure 3:
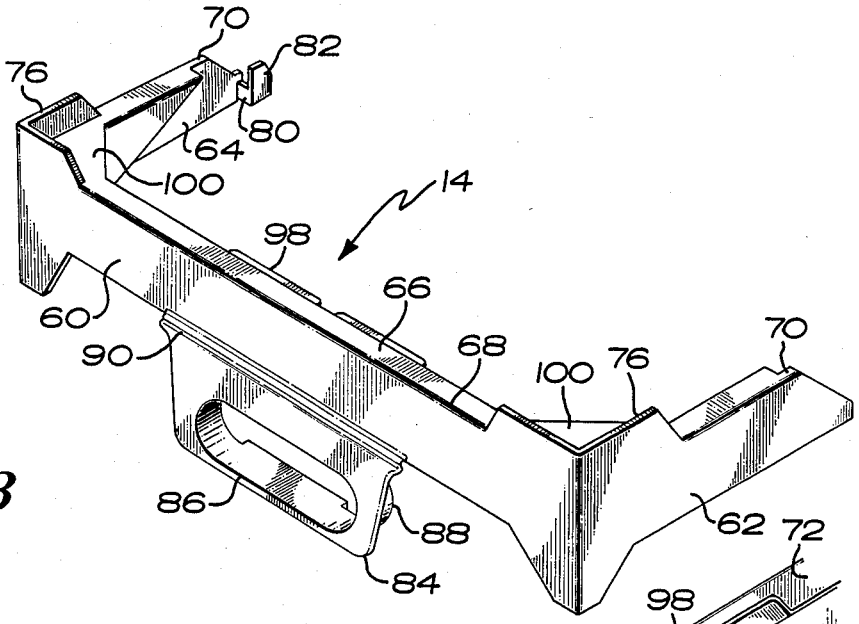
FIG. 3 is a perspective view of the top of a frame grip member.
Figure 4:
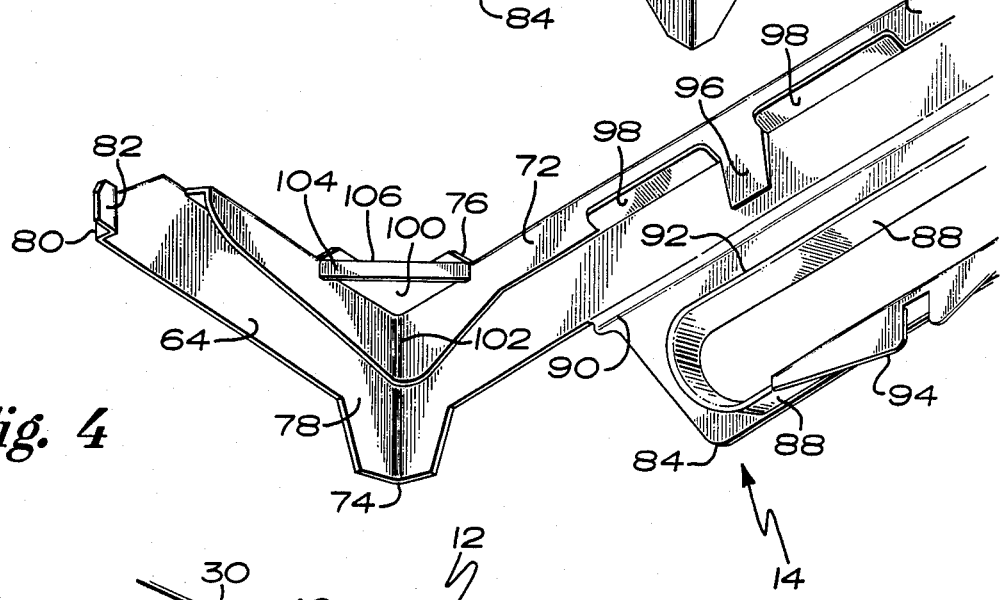
FIG. 4 is a perspective view showing the bottom of a frame grip member.

Referring to FIGS. 3 and 4, the combined frame grip 14 is injection molded as a unitary piece of flexible, high impact plastic in a U-shape having a beam 60 and side extensions 62 at each end of the beam 60. The beam 60 is the same length as the distance between the outside of the side wall panels 30 when folded to their upright position, and the inner surfaces the side extensions 64 confront the outside of the side wall panels 30. A top shoulder member 66 extends inwardly from the top of the beam 68 and the top of the end extensions 70 a distance equal to the combined widths of the end wall panels 36 and end fold-over panels 50. A shoulder lip member 72 extends downward from the top shoulder member 66 parallel to the beam 60 and side extensions 62 and confronting the inside surface and fold-over panels 50 and the side wall panels 30.

Figures 6, 7, 8:
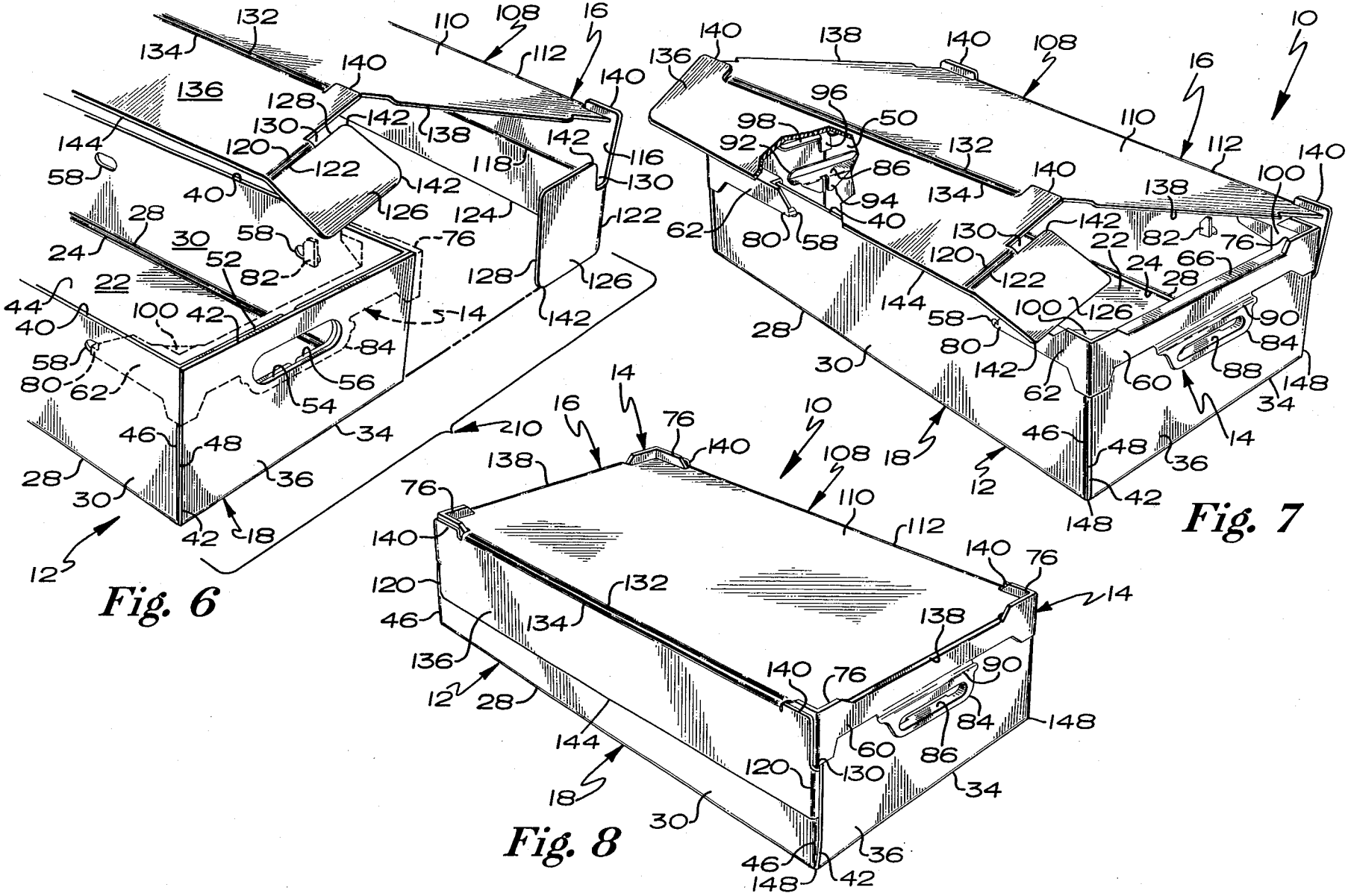
FIG. 6 is a perspective view of the tote container lid being inserted into the body of the tote container.
FIG. 7 is a perspective view showing the lid of the tote container being closed over the top of the container body and the frame grip members.
FIG. 8 is a perspective view of the tote container with the frame grip members and lid completely assembled.

The beam 60 and side extensions 62 may be extended upward above the top shoulder member 66 near the joint 74 between the side extensions 62 and beam 60 to form an L-shaped retaining rim 76. The beam 60 and side extensions 62 may also be extended downward near the joint 74, and the shoulder lip member 72 may be extended downward correspondingly, to form a corner retaining channel 78. The inner surfaces of the corner retaining channel 78 which oppose and contact the side walls panels 30, and wall panels 36, or end foldover panels 50, are substantially smooth over the length of the frame grip member 14. The L-shaped retaining rims 76 may be placed at only one end of the beam 60 so that retaining rims 76 will be diagonally opposite each other on the container 10, which allows stacked containers 10 to be slid into place, yet still affords a degree of retention for stacked containers. Extending inward at the end of each side extension 62 opposite the beam 60 a distance equal to the thickness of the side wall panels 30 is a thin bridge piece 80. Connected to each bridge piece 80 is a key member 82. Each key member 82 is shaped to correspond to the oblate keyholes 58 in the side wall panels 30, and sized so that the key members 82 will fit through the keyholes 58 in a first orientation wherein the beam 60 is above the container 10 and the side extensions are pointed downward, but will not fit through the keyholes 58 in a second orientation rotated ninety degrees in relation to the first orientation as shown in FIG. 6. It is understood that one key member 82 may be omitted, and the frame grip 14 attached on that end by the bridge piece 80 alone.

Extending downward from the center of the beam 60 is a handgrip reinforcing member 84 which defines a reinforcing member handgrip opening 86 corresponding to the handgrip opening 54 in each end of the body 12. A handgrip rim 88 extends inward from the edge of the reinforcing member handgrip opening 86 perpendicular to the surface of the handgrip reinforcing member 84 and through the handgrip opening 54 a distance equal to the width of the top shoulder member 66. The handgrip reinforcing member 84 is connected to the beam 60 across a scored hinge line 90. Extending downward from the inner edge of the handgrip lip 92 are a pair of handgrip retention tabs 94 which hold the handgrip rim 88 within the handgrip opening 54 of the body 12.

Projecting downward from the center of the shoulder lip member 72 confronting the beam 60 is a central retention tab 96 which extends a length approximately equal to half the height of the beam 60. Projecting inward perpendicular to the shoulder lip member 72 on each side of the central retention 96 is a positioning tab 98 having a width approximately equal to that of the top stacking shoulder 66.

Corner stacking shoulders 100 may be molded near the inside corners 102 of the frame grip 14 flush with the upper surface of the top stacking shoulder 66, connecting a section of the shoulder lip member 72 parallel to the beam 60 with a section of the shoulder lip member 72 parallel to the side extensions 62. Each corner stacking shoulder 100 may also have a reinforcing member 104 extending downward from the inner edge 106 of the corner stacking shoulder 100 and connected to the adjacent surfaces of the shoulder lip member 72.

A warp is incorporated into the frame grip member 14 during molding using techniques known to those in the plastic molding field. Once the molded frame grip member 14 cools after molding, this warp permits the frame grip member 14 to be attached to the container body 12 more easily. The inner surfaces of the retaining channels 78 should be smooth. The absense of any ribs or projections on the interior surface of the retaining channel 78 which contact and abut the wall panels 30, 36 and foldover panels 50 make attachment and removal of the frame grip members 14 more convenient.

The combined frame grip 14 described above may also be used with existing utility tote containers 10 having similar handgrip openings 54 in their body 12. A frame grip 14 without the handgrip reinforcing member 84 may be used with utility tote containers 10 which do not have handgrip openings 54 or which do not require those handgrip openings 54 to be reinforced, but for which it is still desirable to use such a frame grip member 14 to secure the wall panels 30, 36 in their upright assembled position, to prevent damage to the corners of the container 10, or to stack several like containers 10 in a vertical column. The frame grips 14 may still include any combination of such features as the L-shaped retaining rims 76, corner retaining channels 78, key members 82, handgrip retention tabs 94, central retention tabs 96, positioning tabs 98, and corner stacking shoulders 100. Each feature above may be positioned as would be suitable for the particular container 10, and the container may be retrofitted with key holes 58 or handgrip openings 54 if desired.

The lid unit 16 is constructed from a single sheet of corrugated plastic which is cut and scored to form a lid blank 108 as shown in FIG. 2. The lid unit 16 consists of a generally rectangular, planar lid panel 110 with dimensions approximately equal to the length and width of the open top receptacle 20. Extending from one side edge 112 of the lid panel 110 and hingedly connected thereto along double score lines 114 is a lid hinge panel 116. The lid hinge panel 116 is divided lengthwise parallel to the one side edge 112 of the lid panel 110 by a scored hinge line 118, the distance between the one side edge 112 of the lid panel 110 and the hinge line 118 being approximately equal to the distance between the top of the L-shaped retaining rim 76 and bottom of the joint 74 on the frame grip 14. Extending outward from the side edges 120 of the lid hinge panel 116 and hingedly connected thereto across a scored fold line 122 between the fold line 118 and the outer edge 124 of the lid hinge panel 116 is a securing tab 126. The securing tab 126 is L-shaped, and the inner edge 128 of the securing tab 26 extends a short distance parallel to the form a locking notch 130 between the securing tab 126 and the section of the lid hinge panel 116 between the hinge line 118 and the one side edge 112 of the lid panel 110. The locking notch 130 is approximately as wide as the thickness of side extension 62 of the frame grip. The locking notch 130 extends inwardly from the inner edge 128 of the securing tab 126 so that the locking notch 130 faces and opposes the frame grip member 14 when then securing tabs 126 are inserted between the end wall panels 36 and end foldover panels 50 of the folded container body 12. The open end of the notches 130 are wider than the thickness of the plastic forming the corner retaining channels 78 so that a portion of the corner retaining channels 78 may be slidably inserted into the notching 130. This permits the lid 16 to be firmly secured to the container body 12 and frame grip member 14 even when the container 10 is completely inverted.

At the opposing side 132 of the lid panel 110 from the lid hinge panel 116 and hingedly connected to the lid panel 110 across double score lines 134 is a lid securing panel 136 having two securing tabs 126, the lid securing panel 136 and securing tabs 126 being the same in size as the lid hinge panel 116, and with the pair of securing tabs 126 connected to the lid securing panel 136 in the same manner and with the same dimensions as on the lid hinge panel 116, with the exception that the fold line 118 may optionally be omitted from the lid securing panel 136.

The end edges 138 of the lid panel 110 may be extended outwards the thickness of the L-shaped retaining rims 76 along a portion between the retaining rims 76 above the beam 60. A section at each end of lid hinge panel 116 and the lid securing panel 136 between the double score lines 134 may be cut through along a line 140 corresponding to the outline shape of the retaining rim 76 extending above the side extensions 62 of the frame grip 14, the line 140 directed parallel to or away from the lid panel 110.

The lid unit 16 may be used separately with any tote container design in which a space or opening is left between the edges 46 of the side wall panels 30 and the adjacent edges of the end wall panels 36. The space between these adjacent edges may be formed either by leaving the panels 30, 36 unconnected or unfastened, by cutting a slot through any seam or fold, or by having end foldover panels 50 as described above. The adjacent top corners of the side panels 30 and end wall panels 36 should be connected to support the lid unit 16 when the securing tabs 126 are inserted into the space between the adjacent panels 30, 36. The adjacent top corners of the side panels 30 and end wall panels 36 should be connected to support the lid unit 16 when the securing tabs 126 are inserted into the space between the adjacent panels 30, 36. The adjacent top corners of these panels 30, 36 may already be connected by whatever particular means was used to fashion or fold the container 10, or if the panels 30, 36 were not originally connected they may be connected by a frame grip member 14 as described above, or any suitable fastener.

The lid unit 16 may also be constructed with securing tabs 126 which would be inserted on one side of the tote container 10 and Velcro® or another suitable closure device or fastener on the opposite side, so that the lid unit 16 may be folded over the top of the receptacle 38 and secured in place.

In operation, the body 12 is folded to its upright position as described above and shown in FIG. 5. One of the frame grips 14 is positioned above the body 12 with the side extensions 62 pointing downward toward the base panel 22 and communicating with the keyholes 58 on opposing sides of the body 32. One key member 82 is inserted through each keyhole 58 from the outside of the body 12. The frame grips 14 are then rotated downward ninety degrees toward a second engaged position at the ends of the body 38, while the handgrip reinforcing members 84 are bent outward along the scored hinge line 90 so the inner edge of the handgrip lip 92 passes outside the body 12 as the reinforcing member handgrip openings 86 are brought into position parallel to and communicating with the handgrip openings 54 in the body 12. The corner retaining channels 78 are simultaneously fitted over the top edges of the side wall panels 30, end wall panels 36, and end fold-over panels 50 and the frame grip 14 is seated by pressing downward on the positioning tabs 98 until the lower surface of the stacking shoulder 66 rests on top of the side wall panels 30, end wall panels 36, and end fold-over panels 50 as shown in FIG. 6. The central retention tabs 96 aid the handgrip retention tabs 94 in holding the end fold-over panels against the end wall panels 36 as seen in FIG. 7. The handgrip rims 88 are then pressed through the handgrip openings 54 and handgrip cutouts 56 so that the handgrip retention tabs 94 hook inside the end fold-over panels 50.

The securing tabs 1 26 on the lid hinge panel 116 are folded upward ninety degrees over the fold lines 122, and may then be inserted between the end wall panels 36 and the end fold-over panels 50 at each end of the body 38, with the locking notches 130 directed upwards to engage the bottom of the side extensions 62 adjacent the joint 74 to hold the lid panel 110 securely in place as shown in FIG. 6. The corners ofthe securing tabs 142 should be rounded, and the lid hinge panel flexed along fold line 118, to accommodate a tight fit between the lid hinge panel 116 and the body 12.

If an existing utility tote container 10 is being used, or is modified to be used, with the described frame grip members 14, and the body 12 of the container 10 does not have end wall panels 36 and end foldover panels 50 between which the securing tabs 126 on the lid 16 may be inserted, the retaining channels 78 of the frame grip 14 may be made wider to accommodate the thickness of the securing tabs 126 on the outside surface of the container 10 parallel to the end wall panels 36.

The lid panel 110 is then folded downward ninety degrees across the double score lines 114 so that the lid panel is disposed over the open top of the receptacle 44, and the end edges 138 and side edges 112, 132 of the lid panel 110 extend outward between the L-shaped retaining rims 76 of the frame grips 14 to keep the lid panel 110 aligned over the top of the receptacle 44.

The securing tabs 126 connected to the lid securing panel 136 are then folded downward ninety degrees over fold lines 122, and the lid securing panel 136 is folded downward ninety degrees over the double score lines 134 while the securing tabs 126 are inserted between the end wall panels 36 and the end foldover panels 50 at each end of the body 38, with the locking notches 130 directed upwards to engage the bottom of the side extensions 62 adjacent the joint 74 as shown in FIG. 8. It is understood that for various sized and shaped seucring tabs 126 it may be necessary to flex the lid securing panel 136 to insert the securing tabs 126 between the end wall panels 36 and the end foldover panels 50.

The container 10 may be opened and closed by removing and inserting the securing tabs 126 on the lid securing panel 136 which hold down the lid panel 110 and pivoting the lid panel 110 along the hinge line 118 and score line 114 from its closed position 144 disposed over the top of the receptacle 20 as shown in FIG. 8, and an open position 146 as shown in FIG. 7. Furthermore, the entire lid unit 16 may be removed, and the container 10 and frame grip 14 disassembled, by reversing the above steps.

When a plurality of the containers 10 of this invention are used, they may be stacked one on top of another, with the base panel 22 of the body 12 of a container 10 on top nesting within the L-shaped retaining rim 76 of the container 10 below, and supported by the top stacking shoulders 66 and corner stacking shoulders 100 of the frame grips 14 of the container 10 below. The corner stacking shoulders 100 provide greater surface area upon which to rest the outside corner 148 of a container 10 when that container 10 is set down on top of a second container 10 without being completely aligned within the L-shaped retaining rims 76 of the second container 10 below. The containers 10 may be stacked with or without the lid units 16 attached.

What is claimed is:

1. A storage and tote container stackable in a vertical column with other like containers, said container comprising:

a substantially rectangular container body including a generally rectangular base panel having two opposing side edges and two opposing end edges, two substantially rectangular and generally vertical side wall panels connected to and extending upwardly from said base panel adjacent said opposing side edges, two substantially rectangular and generally vertical end wall panels connected to and extending upwardly from said base panel adjacent said opposing end edges, each said end wall panel defining a handgrip opening extending through the surface thereof, and a pair of end fold-over panels extending from each said side wall panel and hingedly connected thereto along scored fold lines, said end fold-over panels being folded generally perpendicular to said side wall panel and generally parallel to said end wall panel adjacent said side wall panel, each said end fold-over panel defining a handgrip cutout communicating with the overlapping a region of said handgrip opening in said end wall panel, with said base panel and said side wall panels and end wall panels defining a generally rectangular open top receptacle;

at least one combined frame grip member including means for mounting said frame grip member to said container body, said mounting means including means for connecting said frame grip member to at least one of said side walls and, one or more handgrip reinforcing members removably insertable through said handgrip openings, said mounting means extending between said one of said side walls and said end wall, said mounting means preventing said frame grip member from being moved upward relative to said open top of said container body unless said mounting means is disengaged from said one of said side wall panels and said handgrip openings, and retaining means for retaining the like container on top ofthe container when the containers are stacked in the vertical column; and a lid unit removably mountable on said body, said lid unit being hingedly movable between a closed position disposed o ver said open top receptacle and an open position, said lid unit including a plurality of securing tabs extending outwardly from said lid unit and being connected thereto along scored fold lines, said securing tabs being slidably engagable under at least a portion of said frame grip member extending between said one of said side walls and said end wall when said lid unit is moved to said closed position.

2. The storage and tote container of claim 1 wherein one or more of the securing tabs have an inner edge and further define one or more notches, said notches having an open end defined by said inner edge and said notches extending inwardly from said inner edge such that said open end of said notch faces generally toward the frame grip member when the securing tabs are inserted between the end wall panel and the end foldover panel of the body.

3. The storage and tote container of claim 2 wherein the open end of the notches are wider than at least a portion of the frame grip member such that said portion of the frame grip member may be slidably received within the notch, whereby the lid may be secured to body and frame grip member of the container.

4. The container of claim 1 wherein:

the side wall panels and the end wall panels each have a top edge and a bottom edge, said top edges being generally coplanar and defining four top corners of the receptacle, and wherein the frame grip member has one or more retaining channels to removably engage said top edge of at least one of the end wall panels and said top edge of at least one of the side wall panels adjacent one of said top corners.

5. The container of claim 4 wherein the interior surfaces of the retaining channels contacting and abutting the side wall panels, end wall panels, or end foldover panels are substantially smooth.

6. The container of claim 1 wherein:

the frame grip member has at least one stacking shoulder extending inwardly from the frame grip member for supporting the bottom of the like container on top of the container when the containers are stacked in the vertical column.

7. The container of claim 1 wherein:

the retaining means includes one or more retaining rims projecting generally upward from said frame grip member for retaining the bottom edges of the like container on top of the container when the containers are stacked in the vertical column.

8. The container of claim 1 wherein:

the side wall panels each define at least one keyhole extending through the surface thereof; and the means for attaching the frame grip member to the body includes at least one pair of keys extending from opposing ends of the frame grip member and positionable to communicate with said keyholes in opposing side wall panels, said keys being removably insertable through said keyholes when the frame grip member is positioned above the body, and said keys being engagable in said keyholes when said frame grip member is rotated downward to an engaged position.

9. The container of claim 1 further comprising:

a corner stacking shoulder extending inwardly from each of said opposing ends of said frame grip member adjacent said top corners of said receptacle.

10. A storage and tote container comprising:

a substantially rectangular container body having a base panel, two side wall panels, and two end wall panels, said base panel, side wall panels, and end wall panels assembled to form a generally rectangular open top receptacle each said side wall panel and said end wall panel forming a gap therebetween;

at least one removable combined frame grip member including means for engagingly mounting said frame grip member to said container body, such that said frame grip member extends between and interconnects at lease one of said side wall panels and one of said end wall panels, said frame grip member including mounting means associated with at least one of said side wall panels and one of said end wall panels for engagingly mounting said frame grip member on said open top of said container body such that said frame grip member cannot be moved upwardly relative to said open top of said container body without disengaging said mounting means; and a lid unit removably mountable on said body, said lid unit being hingedly movable between a closed position disposed over said open top receptacle and an open position said lid unit defining a plurality of securing tabs extending outwardly from said lid unit and attached thereto along scored fold lines, each said securing tab being slidably engageable between one of said side wall panels and one of said end wall panels below frame grip member, said securing tabs engaging at least a portion of said frame grip member extending between said one of said side wall panels and said one of said end wall panels when said lid unit is in said closed position.

11. The storage and tote container of claim 10 further comprising:

a pair of end fold-over panels extending from each of the side wall panels and hingedly connected thereto along scored fold lines, said end fold-over panels be folded generally perpendicular to the side wall panel and generally parallel to the end wall panel adjacent the side wall panel.

12. The storage and tote container of claim 11 wherein one or more of the securing tabs have an inner edge and further define one or more notches, said notches having an open end defined by said inner edge and said notches extending inwardly from said inner edge such that said open end of said notch faces generally toward the frame grip member when the securing tabs are inserted between the end wall panel and the end foldover panel of the body.

13. The storage and tote container of claim 12 wherein the open end of the notches are wider than at least a portion of the frame grip member such that said portion of the frame grip member may be slidably received within the notch, whereby the lid may be secured to the body and frame grip member of the container.

14. The storage and tote container of claims 11 or 12 wherein:

the side wall panels and the end wall panels each have a top edge and a bottom edge, said top edges being generally coplanar and defining four top corners of the receptacle, and wherein the frame grip member has one or more retaining channels to removably engage said top edge of at least one of the end wall panels and said top edge of at least one of the side wall panels adjacent one of said top corners.

15. The container of claim 14 wherein the interior surfaces of the retaining channels contacting and abutting the side wall panels, end wall panels, or end fold-over panels are substantially smooth.

16. The container of claims 10, 11 or 12 wherein:

the frame member has at least one stacking shoulder extending inwardly from the frame grip member to support the bottom edges of the like container on top of the container when the containers are stacked in the vertical column.

17. The container of claims 10, 11 or 12 stackable in a vertical column with other like containers, said container further comprising:

retaining means for retaining the like container on top of the container when the containers are stacked in a vertical column, said retaining means including one or more retaining rims projecting generally upward from the frame grip member for retaining the bottom edges of the like container on top of the container when the containers are stacked in the vertical column.

18. The storage and tote container of claims 10, 11 or 12 wherein the end wall panels define a pair of handgrip openings extending through the surface thereof, and further comprising a pair of enclosed handgrip reinforcing members extending completely around said handgrip openings at least partially hingedly connected to and extending generally downwardly from said frame grip member and removably insertable through said handgrip openings.

19. In a tote container defining an open top receptacle and having side wall panels and end wall panels, said side wall panels having adjacent side edges and adjacent top corners, a space being presented between said adjacent edges of said side panels and wall panels, with a removable reinforcing frame member extending between and interconnecting said adjacent top corners above said space, said frame member including mounting means associated with at least one of said side wall panels and one of said end wall panels for engagingly mounting said frame member on said open top of said container such that said frame member cannot be moved upwardly relative to said open top of said container without disengaging said mounting means the improvement comprising:

a lid unit for removably mounting on the tote container, said lid unit being hingedly movable between a closed position disposed over the open top receptacle and a closed position, said lid unit having at least a pair of securing tabs extending outwardly from each end of the lid unit and connected thereto along scored fold lines, each said securing tab being slidably engageable within the space between the adjacent edges of the side and end wall panels below the frame member, each said securing tab defining a notch which slidably received and engaged at least a portion of the frame member when the securing tab is slidably engaged within the space between the adjacent edges of the side and end wall panels.

20. A storage and tote container comprising:

a substantially rectangular container body having a base panel, two side wall panels, and two end wall panels, said base panel, side wall panels, and end wall panels being assembled to form a generally rectangular open top receptacle, with each of said side wall panels further defining at least one keyhole extending through the surface thereof;

at least one combined frame grip member having opposing ends and including means for engagingly mounting said frame grip member to said container body, said means for engagingly mounting said frame grip member including at least a pair of keys extending from said opposing ends of said frame grip member and positionable to communicate with said keyholes in opposing side wall panels, said keys being removable insertable through said keyholes when said frame grip member is positioned above said container body, and said keys being engageable within said keyholes and when said frame grip member is rotated downward to an engaged position on said open top of said container body; and a lid unit removably mountable on said container body, said lid unit being hingedly movable between a closed position disposed over said open top receptacle and an open position.

21. The storage and tote container of claim 20 further comprising:

a pair of end fold-over panels extending from each of the side wall panels and hingedly connected thereto along score fold lines, said end fold-over panels being folded generally perpendicular to the side wall panel and generally parallel to the end wall panel adjacent the side wall panel to which said end fold-over panel is connected.

22. The storage and tote container of claim 20 further comprising:

at least a pair of securing tabs extending outwardly from each end of the lid unit and connected thereto along scored fold lines, each said securing tab being slidingly engageable between the adjacent side and end wall panels and below the frame grip member.

23. The storage and tote container of claim 22 wherein at least one of the securing tabs has an inner edge and further defines a notch, said notch having an open end defined by said inner edge with said notch extending inwardly from said inner edge such that said open end of said notch faces generally toward the frame grip member when the securing tab is inserted beneath the frame grip member, such that at least a portion of the frame grip member may be slidably received within said notch, whereby the lid may be secured to the frame grip member and container body.

* * * * *